US010654630B2

(12) United States Patent
Cheng

(10) Patent No.: US 10,654,630 B2
(45) Date of Patent: May 19, 2020

(54) LID AND CONTAINER INCLUDING THE SAME

(71) Applicant: Zhejiang Haoda Science & Technology Co., Ltd, Jinhua (CN)

(72) Inventor: Haojun Cheng, Jinhua (CN)

(73) Assignee: Zhejiang Haoda Science & Technology Co., Ltd, Jinhua (CN)

( * ) Notice: Subject to any disclaimer, the term of this patent is extended or adjusted under 35 U.S.C. 154(b) by 0 days.

(21) Appl. No.: 16/239,459

(22) Filed: Jan. 3, 2019

(65) Prior Publication Data

US 2020/0122903 A1 Apr. 23, 2020

(30) Foreign Application Priority Data

Oct. 22, 2018 (CN) ..... 2018 1 1228115
Oct. 22, 2018 (CN) ..... 2018 2 1708900 U

(51) Int. Cl.

| | |
|---|---|
| ***A47G 19/22*** | (2006.01) |
| ***B65D 47/20*** | (2006.01) |
| ***B65D 47/06*** | (2006.01) |
| *B65D 25/40* | (2006.01) |

(52) U.S. Cl.

CPC ..... *B65D 47/2037* (2013.01); *A47G 19/2222* (2013.01); *A47G 19/2272* (2013.01); *B65D 47/066* (2013.01); *B65D 2547/066* (2013.01)

(58) Field of Classification Search

CPC ..... A47G 19/2222; A47G 19/2272; B65D 47/2037; B65D 47/066; B65D 2547/066
USPC ..... 220/709, 705, 707, 719
See application file for complete search history.

(56) References Cited

U.S. PATENT DOCUMENTS

| | | | | |
|---|---|---|---|---|
| 4,684,032 | A * | 8/1987 | Tsay | A47J 41/0027 215/12.1 |
| 5,465,866 | A * | 11/1995 | Belcastro | A47G 19/2272 220/709 |
| 9,770,667 | B1 * | 9/2017 | Wang-Wu | A63H 3/005 |
| 2002/0008109 | A1 * | 1/2002 | Hirota | B65D 43/0212 220/258.2 |
| 2015/0259105 | A1 * | 9/2015 | Martinez | B65D 39/0052 220/233 |
| 2016/0178071 | A1 * | 6/2016 | Javeheri | F16K 7/075 137/1 |
| 2017/0066568 | A1 * | 3/2017 | Stever | B65D 47/06 |
| 2019/0161251 | A1 * | 5/2019 | Fang | A47G 19/2266 |
| 2019/0389633 | A1 * | 12/2019 | Beijl | B65D 47/066 |

* cited by examiner

*Primary Examiner* — J. Gregory Pickett
*Assistant Examiner* — Niki M Eloshway

(57) ABSTRACT

The present disclosure discloses a lid, including a lid body with a hole; an elastic sleeve having a bore extending therethrough, a part of the elastic sleeve extending through the hole, the elastic sleeve elastically deformable between a torsional state and a non-torsional state; an elastic spout extending through the bore of the elastic sleeve, the elastic spout being open when the elastic sleeve is in the non-torsional state and being deformed to close when the elastic sleeve is in the torsional state; a rotating member configured for twisting the elastic sleeve to the torsional state; a locking member having a locking state for keeping the elastic sleeve in the torsional state, and a releasing state for allowing the elastic sleeve to return to the non-torsional state; and an elastic member interacting with the locking member for driving the locking member to remain in the locking state.

14 Claims, 11 Drawing Sheets

LID AND CONTAINER INCLUDING THE SAME

CROSS-REFERENCE TO RELATED APPLICATIONS

This application claims all benefits accruing under 35 U.S.C. § 119 from China Patent Application Nos. 201811228115.0, filed on Oct. 22, 2018, and 201821708900.1, filed on Oct. 22, 2018, in the State Intellectual Property Office of China, the content of which is hereby incorporated by reference.

TECHNICAL FIELD

The present disclosure relates to daily necessities, in particular to a lid and a container including the same.

BACKGROUND

In the prior art, a container with a spout is widely used. The container generally includes a lid and a container body connected to each other. The spout is inserted and fixed on the lid. When the container is accidentally tilted or tipped over, the liquid will fall out through the spout, spilling on the table or splashing the user, causing inconvenience to the user.

SUMMARY

In order to provide a container with a spout, which is easy to open and close, and convenient to use, an embodiment of the present disclosure includes a lid, including a lid body with a hole, an elastic sleeve having a bore extending therethrough, a part of the elastic sleeve extending through the hole, the elastic sleeve elastically deformable between a torsional state and a non-torsional state; an elastic spout extending through the bore of the elastic sleeve, the elastic spout being open when the elastic sleeve is in the non-torsional state, the elastic spout being deformed to close when the elastic sleeve is in the torsional state; a rotating member rotatably assembled on the lid body and configured for twisting the elastic sleeve to the torsional state to cause the elastic sleeve to press and deform the elastic spout; a locking member movably mounted on the lid body, the locking member having a locking state, in which the locking member is interlocked with the rotating member to keep the elastic sleeve in the torsional state, and a releasing state, in which the locking member is separated from the rotating member to allow the elastic sleeve to return to the non-torsional state; and an elastic member positioned between the lid body and the locking member and interacting with the locking member for driving the locking member to remain in the locking state.

The elastic sleeve includes a first linking part, a twisting part and a second linking part. The first linking part is connected to an end of the twisting part and mounted in linkage with the rotating member, and the second linking part is connected to another end of the twisting part and mounted to the lid body.

Furthermore, the twisting part penetrates the lid body through the hole and configured for twisting and pressing the elastic spout to close.

An inner side of the lid body is provided with an annular convex structure in a circumferential direction of the hole. The twisting part of the elastic sleeve penetrates the annular convex structure and the second linking part of the elastic sleeve is fixed on the annular convex structure by a pressure ring.

The annular convex structure is provided with at least one fixing groove, the second linking part is provided with at least one fixing flange, and the at least one fixing flange is coupled to the at least one fixing groove.

The pressure ring is provided with an extending part pressing on the second linking part, and the pressure ring is threadedly engaged to the annular convex structure.

Furthermore, the rotating member includes an actuating element and a base, the actuating element is provided with at least one bulge, the base is provided with at least one notch coupled with the at least one bulge, and the actuating element is mounted on the base by matching the at least one notch with the at least one bulge.

The first linking part is fixed by the actuating element and the base.

The first linking part is provided with at least one limiting gap and at least one location hole separated from the at least one limiting gap, the actuating element is provided with at least one location bar coupled with the at least one location hole, and the at least one location bar is engaged in the at least one location hole, in order to achieve limit between the actuating element and the first linking part. The base is provided with at least one limiting bar separated from the at least one notch and coupled with the at least one limiting gap, and the at least one limiting bar is engaged in the at least one limiting gap, so that the elastic sleeve can be restricted from rotating along an axis of the base.

A mounting groove is defined in an outer side of the lid body around the hole, the locking member is axially slidably disposed in the mounting groove, and the rotating member is located on the locking member.

A button groove connected to the mounting groove is further defined on the outer side of the lid body, the locking member is provided with a release button located in the button groove, and the release button is configured for driving the rotating member to release from the locking member in the releasing state.

The base is further provided with a plurality of limiting gears on a side toward the locking member, and the locking member is provided with a plurality of locking claws that cooperates with the plurality of limiting gears to limit rotation of the base to one direction.

The elastic member is a compression spring disposed in the mounting groove, and one end of the compression spring abuts on the bottom of the mounting groove, and the other end of the compression spring abuts on the locking member and interacts with the locking member.

A container including the lid and a container body is provided.

The lid and the container including the same according to the present disclosure is configured to open and close the elastic spout by the elastic sleeve and cooperation between the rotating member, the locking member and the elastic member, so as to make the elastic spout close and open more conveniently and safely.

DETAILED DESCRIPTION

The present disclosure will be further described in detail below with reference to the drawings and specific embodiments, in order to better understand the objective, the technical solution and the advantage of the present disclosure. It should be understood that the specific embodiments described herein are merely illustrative and are not intended to limit the scope of the disclosure.

It should be noted that when an element is referred to as being "fixed" to another element, it may be directly attached to the other element or a further element may be presented between them. When an element is considered to be "connected" to another element, it may be directly connected to the other element or connected to the other element through a further element (e.g., indirectly connected). The terms as used herein "vertical", "horizontal", "left", "right", and the like, are for illustrative purposes only and are not meant to be the only orientation.

Unless otherwise defined, all technical and scientific terms used herein have the same meaning as a skilled person in the art would understand. The terminology used in the description of the present disclosure is for the purpose of describing particular embodiments and is not intended to limit the disclosure.

Figure 1:
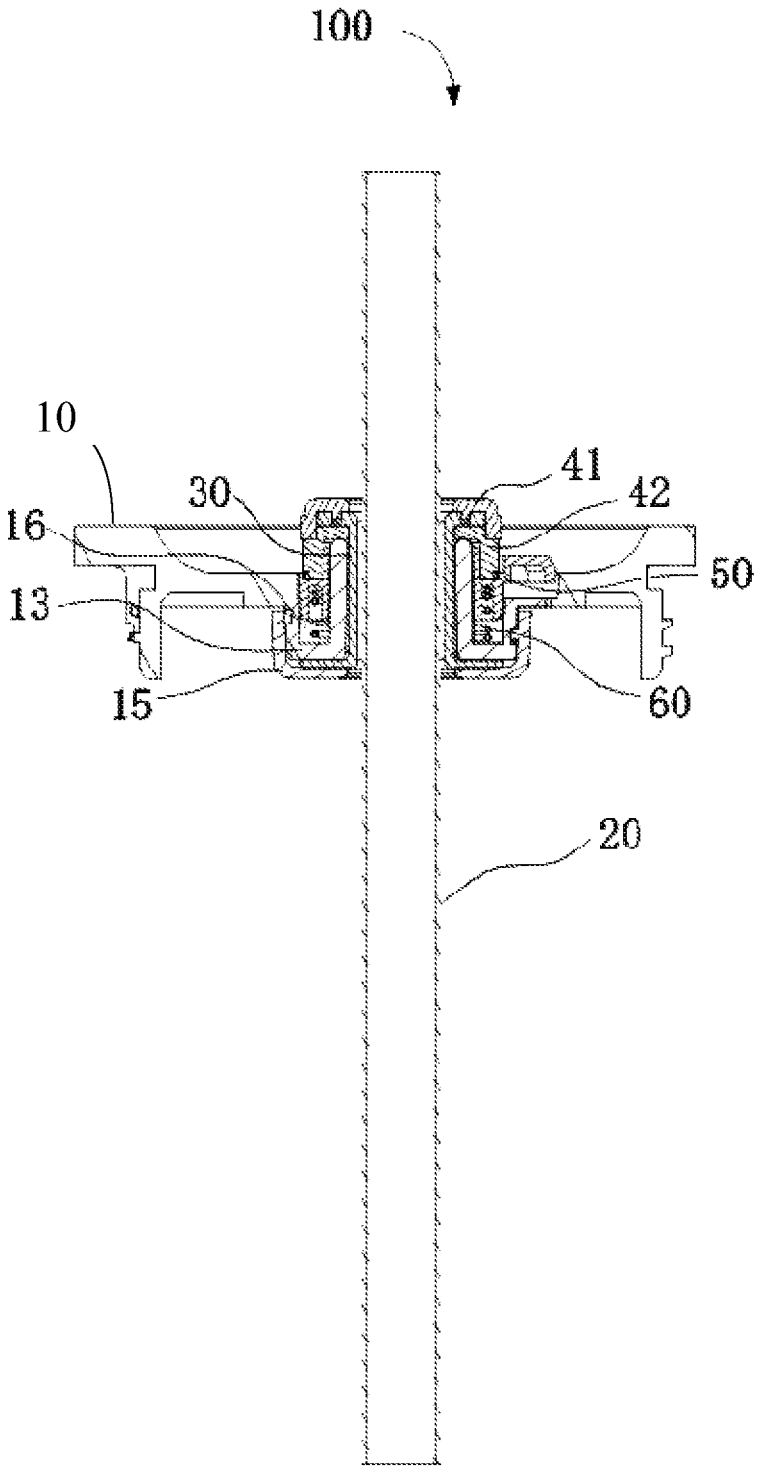
FIG. 1 is a cross-sectional view of a lid according to an embodiment of the present disclosure.
Figure 2:
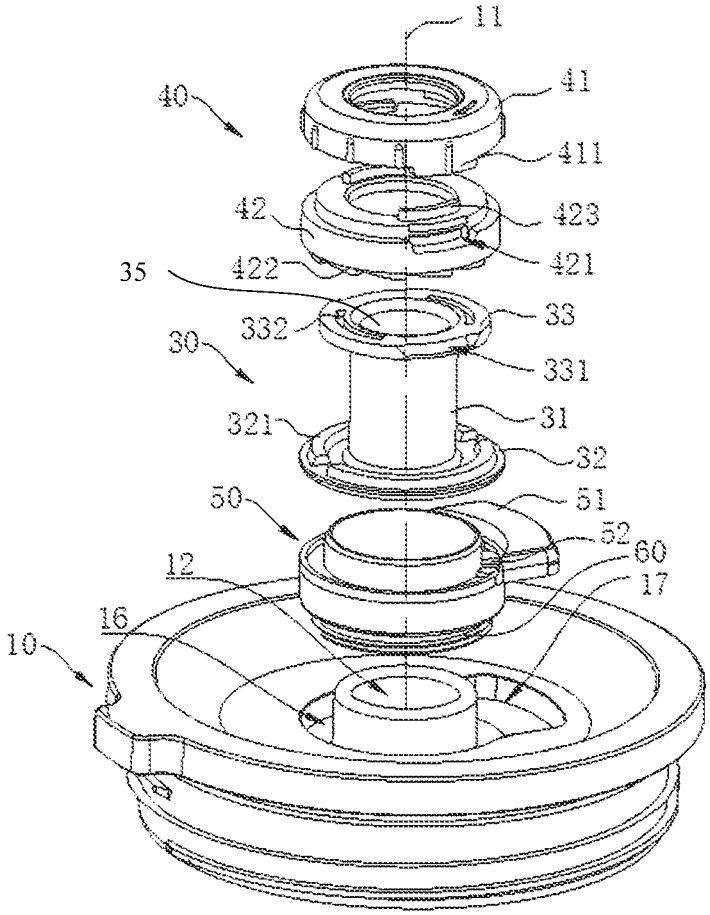
FIG. 2 is an exploded view of the lid shown in FIG. 1, without an elastic spout.
Figure 11:
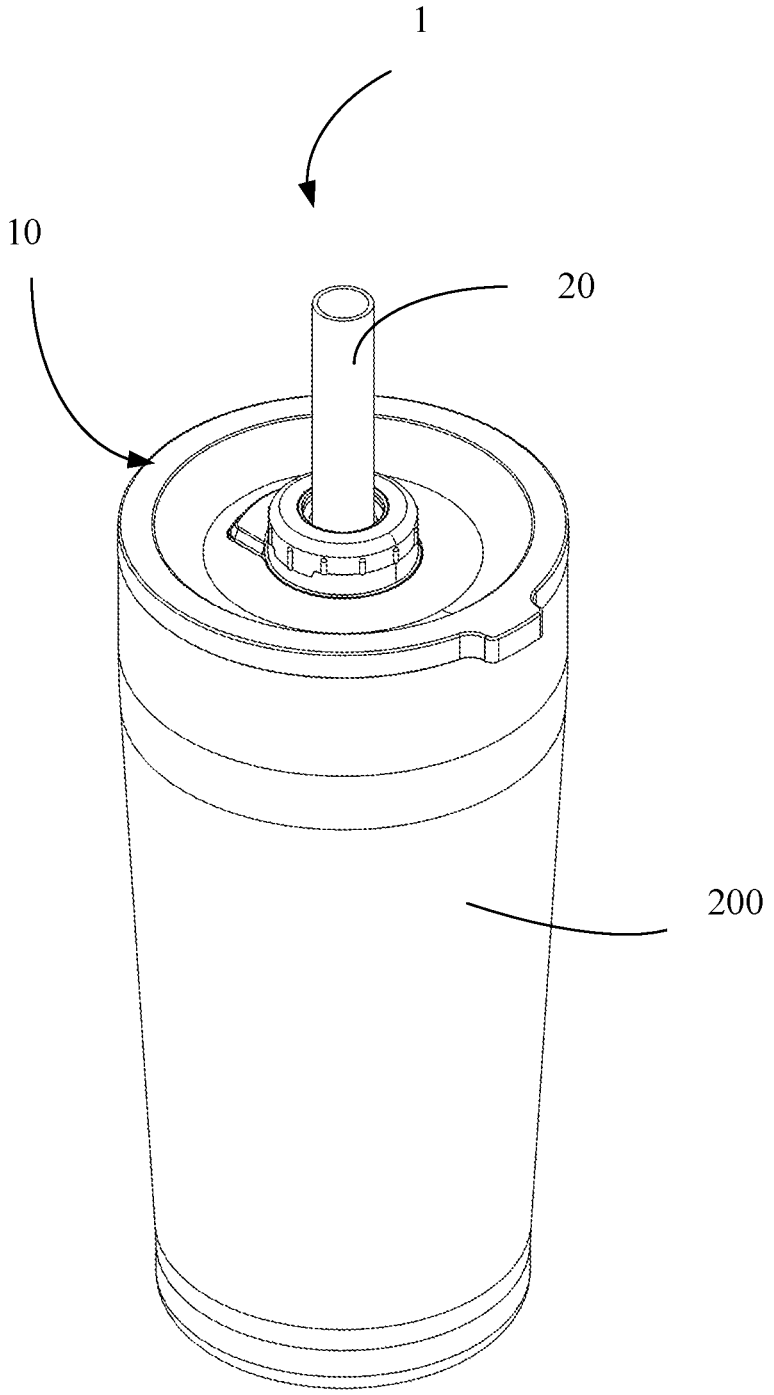
FIG. 11 is a perspective view of a container according to an embodiment of the present disclosure.

Referring to FIG. 1 and FIG. 2, an embodiment of the present disclosure includes a lid 100 including a lid body 10, an elastic sleeve 30, a portion of the elastic sleeve 30 extending through a hole 12 in the lid body 10, and an elastic spout 20 extending through a bore 35 of the elastic sleeve 30, as explained in further detail below. As shown, the elastic spout is tubular and resembles an elastic tube or straw in which fluid can pass through. Referring to FIG. 11, the lid 100 can be coupled with a container body 200. The container body 200 may be sealed and connected with the lid 100 by ways of a threaded engagement, a clamping engagement, or the like.

The elastic sleeve 30 can have two states: a torsional state and a non-torsional state. When the elastic sleeve 30 is in the non-torsional state, the elastic spout 20 is open. When the elastic sleeve 30 is in the torsional state, a part of the elastic spout 20 is deformed to at least partially close off the elastic spout 20 thereby restricting flow through the elastic spout 20.

Figure 9:
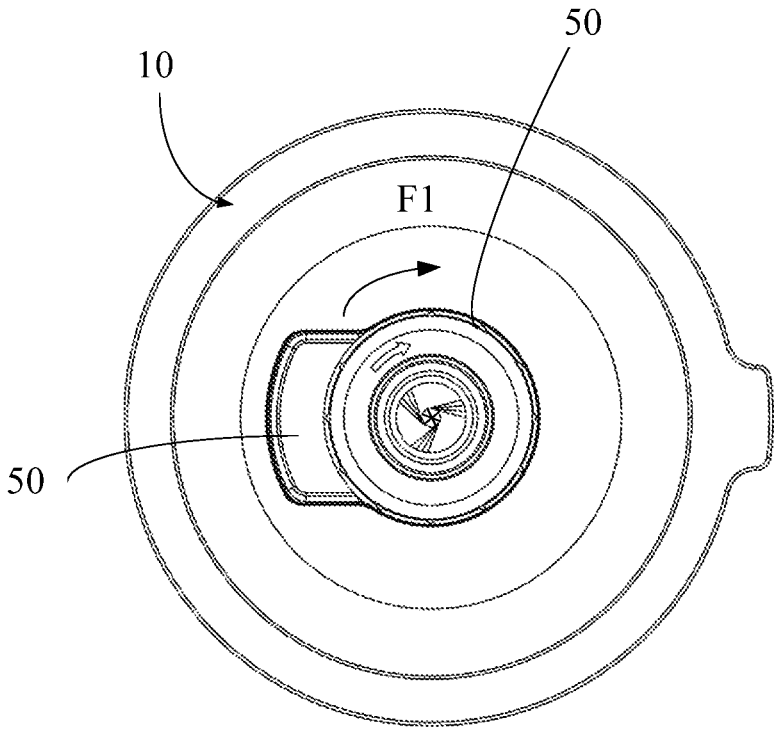
FIG. 9 is a top view of the lid shown in FIG. 1 with the elastic sleeve in the torsional state.
Figure 10:
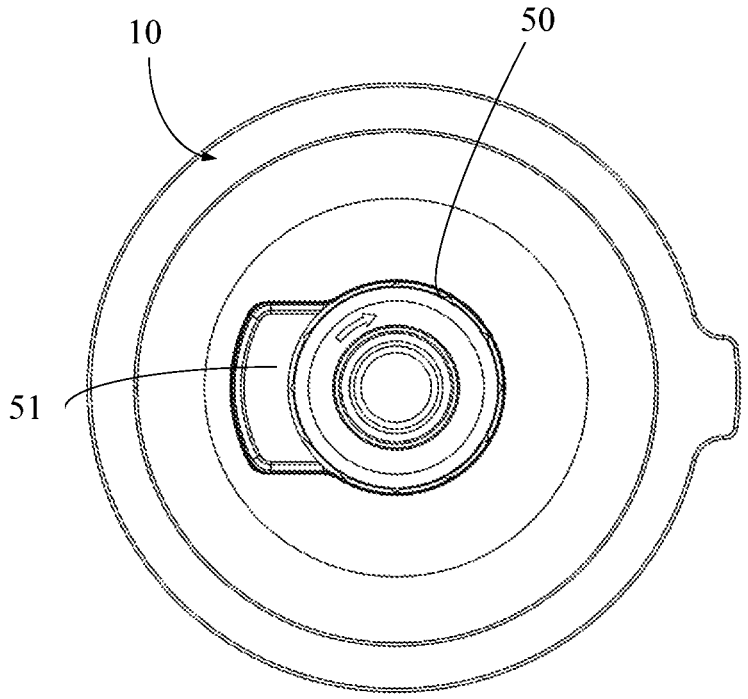
FIG. 10 is a top view of the lid shown in FIG. 1 with the elastic sleeve in the non-torsional state.

The lid 100 further includes a rotating member 40 and a locking member 50. The rotating member 40 can be rotatably assembled on the lid body 10 and configured for twisting the elastic sleeve 30. The elastic sleeve 30 in the torsional state can press, squeeze, or twist the elastic spout 20 to deform until a part of the elastic spout 20 is closed. The locking member 50 can be movably mounted on the lid body 10. The locking member 50 can have a locking state in which the locking member 50 is interlocked with the rotating member 40 to keep the elastic sleeve 30 in the torsional state (as shown in FIG. 9). The locking member 50 further has a releasing state which is separated from the rotating member 40 to release the elastic sleeve 30 up to the non-torsional state (as shown in FIG. 10). The lid 100 further includes an elastic member 60 mounted between the lid body 10 and the locking member 50 and interacting with the locking member 50 for driving the locking member 50 to remain at the locking state.

Referring to FIG. 2, the lid body 10 can have an axis 11 along an axial direction. The locking member 50 can be movably mounted on the lid body 10 by the elastic member 60 and abut toward the rotating member 40.

The elastic spout 20 and the elastic member 30 can be made of elastic material, such as silica gel, which can be twisted or elastically deformed to some extent.

When the elastic sleeve 30 is in the torsional state, a twisting part 31 of the elastic sleeve 30 can be deformed and compress the elastic spout 20. Because of the rotation of the rotating member 40, the twisting part 31 can close inner cavity of the elastic spout 20 to prevent liquid from flowing out through the elastic spout 20. In the non-torsional state, the twisting part 31 is cylindrical having the bore 35 extending therethrough.

The hole 12 is configured for receiving at least part of the twisting part 31 and the bore 35 of the twisting part 31 is configured for receiving the elastic spout 20. The elastic sleeve 30 can extend through the lid body 10 along the hole 12. The elastic sleeve 30 can include a first linking part 33, the twisting part 31 and a second linking part 32. The first linking part 33 is a part of or connected to the elastic sleeve 30 on the outer side of the lid body 10. The first linking part 33 can be connected to an end of the twisting part 31 and mounted in linkage with the rotating member 40. The second linking part 32 is a part of or connected to the elastic sleeve 30 on the inner side of the lid body 10. The second linking part 32 can be connected to another end of the twisting part 31 opposite the first linking part 33, protruding through the hole 12, and mounted to the lid body 10. The twisting part 31 is a middle part of the elastic sleeve 30, which is between the second linking part 32 and the first linking part 33. The twisting part 31 can pass through the hole 12 and sleeve outside a part of the elastic spout 20. The first linking part 33, the twisting part 31 and the second linking part 32 can be an integrated structure. The rotating member 40 can be regarded as being mounted to the lid body 10 indirectly. The word "through" means that when the lid 100 is connected with the container body 200, the space inside the container body 200 can communicate with the outside through the hole 12 or the elastic sleeve 30, "the outer side of the lid body 10" means a side of the lid body 10 away from the container body 200, and "the inner side of the lid body 10" means a side of the lid body 10 toward the container body 200.

Figure 8:
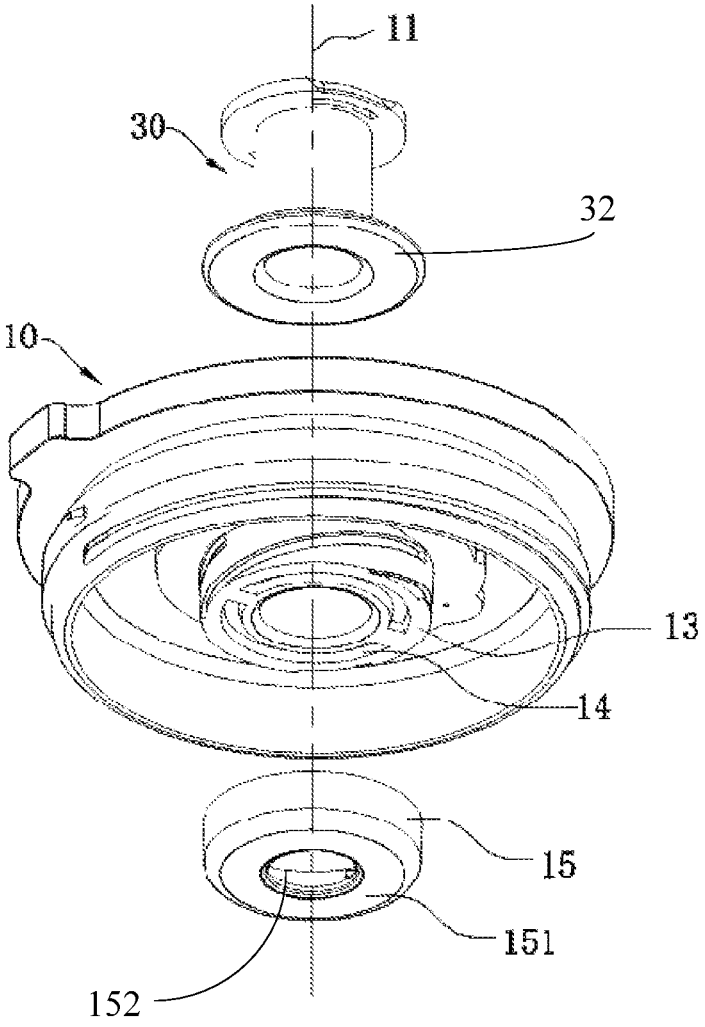
FIG. 8 is a perspective view of the lid body and the elastic sleeve of the lid shown in FIG. 1.

Referring to FIG. 8, an inner side of the lid body 10 can be provided with an annular convex structure 13 in a circumferential direction of the hole 12. The twisting part 31 of the elastic sleeve 30 can penetrate the annular convex structure 13, and the second linking part 32 of the elastic sleeve 30 can be fixed on the annular convex structure by a pressure ring 15.

Figure 5:
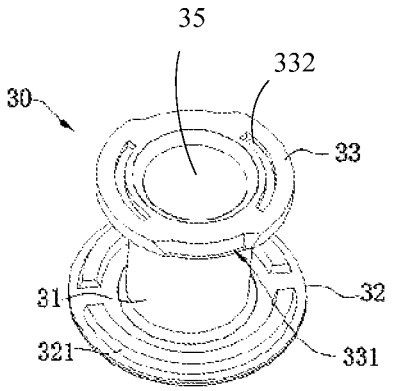
FIG. 5 is a perspective view of an elastic sleeve of the lid shown in FIG. 1.

The annular convex structure 13 can be provided with at least one fixing groove 14. Referring to FIG. 5, the second linking part 32 is provided with at least one fixing flange 321 coupled to the at least one fixing groove 14, thereby fixing the at least one fixing flange 321 between the second linking part 32 and the annular convex structure 13. In this way, the second linking part 32 of the elastic sleeve 30 can be fixed by the pressure ring 15.

Furthermore, referring to FIG. 5, the pressure ring 15 is provided with an extending part 151 and a through hole 152 for the elastic spout 20 to extend through. The extending part 151 abuts and presses on the second linking part 32 tightly. The pressure ring 15 can be screw-mounted to outer sides of the annular convex structure 13.

Figure 3:
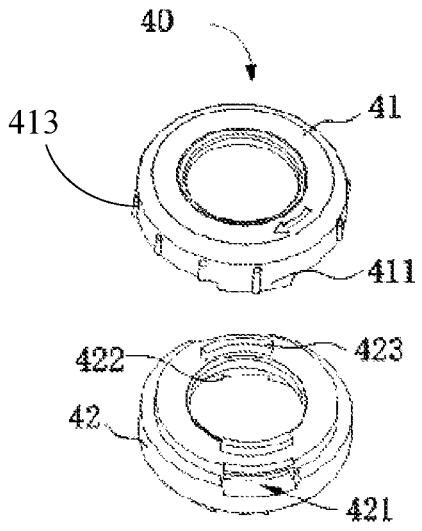
FIG. 3 is an exploded view of a rotating member of the lid shown in FIG. 1.
Figure 4:
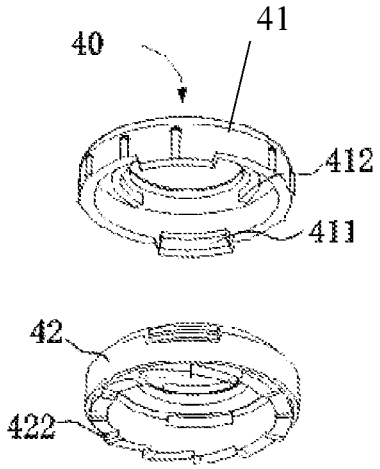
FIG. 4 is an exploded view of the rotating member of FIG. 3, viewed from another perspective.

Referring to FIGS. 2-4, the rotating member 40 can include a base 42 and an actuating element 41 mounted on the base 42. The actuating element 41 can have a substantially annular shape. The actuating element 41 can be provided with at least one bulge 411, and the base 42 can be provided with at least one notch 421 coupled with the at least one bulge 411. The actuating element 41 can be mounted on the base 42 by matching the at least one notch 421 with the at least one bulge 411.

The first linking part 33 of the elastic sleeve 30 can be fixed by the actuating element 41 and the base 42. Referring to FIGS. 3-5, the first linking part 33 of the elastic sleeve 30 can be provided with at least one limiting gap 331 and at least one location hole 332 separated from the at least one limiting gap 331. The actuating element 41 can be provided with at least one location bar 412 coupled with the at least one location hole 332. The at least one location bar 412 can be engaged in the at least one location hole 332, so that the first linking part 33 can be fixed by the actuating element 41. The base 42 can be provided with at least one limiting bar 423 toward the actuating element 41. The at least one limiting bar 423 is separated from the at least one notch 421 and coupled with the at least one limiting gap 331. The at least one limiting bar 423 can be engaged in the at least one limiting gap 331, in order to circumferentially limit between the elastic sleeve 30 and the base 42. In this way, the first linking part 33 of the elastic sleeve 30 can be fixed by the actuating element 41 and the base 42.

Figure 7:
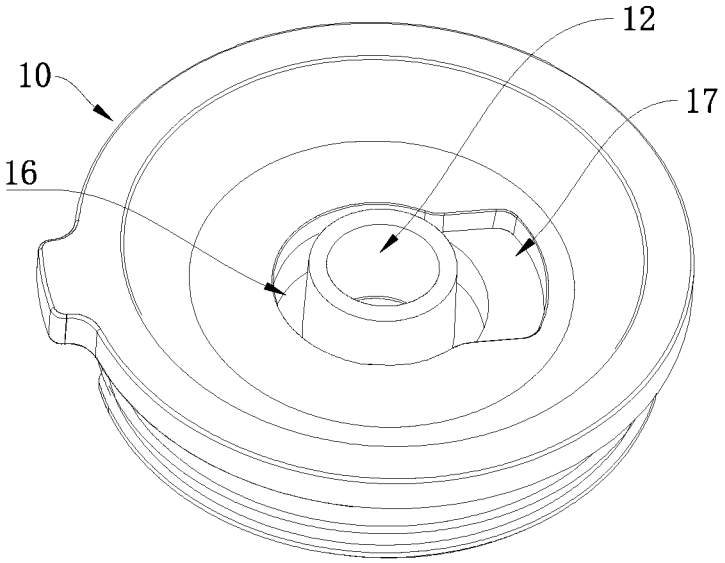
FIG. 7 is a perspective view of a lid body of the lid shown in FIG. 1.

Referring to FIG. 7, a mounting groove 16 can be provided around the hole 12. The locking member 50 can be axially slidably disposed in the mounting groove 16. The rotating member 40 can be located on the locking member 50.

Figure 6:
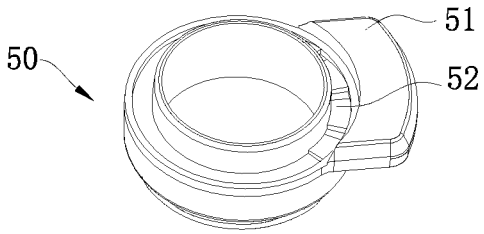
FIG. 6 is a perspective view of a locking member of the lid shown in FIG. 1.

Furthermore, a button groove 17 connected to the mounting groove 16 is further defined on the outer side of the lid body 10. Referring to FIG. 6, the locking member 50 can be provided with a release button 51 located in the button groove 17. The release button 51 can be configured for driving the rotating member 30 to release from the locking member 50 in the releasing state.

As shown in FIGS. 4 and 6, the base 42 can be further provided with a plurality of limiting gears 422 on a side toward the locking member 50. The plurality of limiting gears 422 can be unidirectionally inclining and form depressed steps. The plurality of limiting gears 422 can be formed along a periphery of the base 42. The locking member 50 can be provided with a plurality of locking claws 52 that cooperates with the plurality of limiting gears 422 to limit rotation of the base 42 to one direction. The plurality of limiting gears 422 can also be regarded as a ratchet structure, cooperate with the plurality of locking claws 52 and rotate in one-way direction. That is, referring to FIG. 9, if the rotating member 40 is rotated by a force F1, the base 42 will rotate and the plurality of limiting gears 422 will rotate along the plurality of locking claws 52. In this rotation process, the rotating member 40 is rotating, and the locking member 50 remains still and prevents the rotating member 40 from rotating back to force the elastic sleeve 30 in the torsional state.

When the force F1 is applied in, for example, a clockwise direction, to rotate the rotating member 40, the elastic sleeve 30 will be twisted to a small extent and in the torsional state, and accordingly the elastic spout 20 will be deformed. The twist of the elastic sleeve 30 will generate a restoring force to drive the rotating member 40 to rotate back when the force F1 is removed. In order to maintain the elastic sleeve 30 in the torsional state, the locking member 50 interlocking with the rotating member 40 must be set to prevent the rotating member 40 from rotating back. If the rotating member 40 is further rotated along the direction F1, the elastic sleeve 30 will be twisted to a large extent and then the elastic spout 200 will be closed. The closure of the elastic spout 200 can be maintained by the locking member 50 limiting the rotating member 40 to rotate in only one direction.

Referring to FIG. 2, the elastic member 60 can be a compression spring disposed in the mounting groove 16. One end of the compression spring abuts on the bottom of the mounting groove 16, and the other end of the compression spring abuts on the locking member 50 and interacts with the locking member 50. That is, the elastic member 60 can maintain a compressed state between the lid body 10 and the locking member 50 and provide an elastic force to the locking member 50, in order to keep the locking member 50 in the locking state (as shown in FIG. 9). When the user presses the release button 51, the locking member 50 moves downward along the axial direction of the lid body 10. The elastic member 60 can be compressed more, until the plurality of locking claws 52 are separated from the plurality of limiting gears 422, thereby releasing the locking member 50 from the releasing state (as shown in FIG. 10).

Furthermore, as shown in FIG. 3, the actuating element 41 can be provided with a plurality of anti-slip bulges 413. The plurality of anti-slip bulge 413 is configured for increasing frictional force or grip of the user when rotating the actuating portion 41.

An outer diameter of the twisting part 31 of the elastic sleeve 30 can be smaller than a diameter of the hole 12, and an outer diameter of the elastic spout 20 can be smaller than an inner diameter of the twisting part 31.

As shown in FIG. 11, another embodiment provides a container 1 including the lid 100 and a container body 200.

The lid 100 and the container 1 including the same according to the present disclosure is configured to open and close the elastic spout 20 by the elastic sleeve 30 and cooperation between the rotating member 40, the locking member 50 and the elastic member 60, so as to make the elastic spout close and open more conveniently and safely in use.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A lid, comprising:

a lid body with a hole;

an elastic sleeve having a bore extending therethrough, a part of the elastic sleeve extending through the hole, the elastic sleeve elastically deformable between a torsional state and a non-torsional state;

an elastic spout extending through the bore of the elastic sleeve, the elastic spout being open when the elastic sleeve is in the non-torsional state, the elastic spout being deformed to close when the elastic sleeve is in the torsional state;

a rotating member rotatably assembled on the lid body and configured for twisting the elastic sleeve to the torsional state to cause the elastic sleeve to press and deform the elastic spout;

a locking member movably mounted on the lid body, the locking member having a locking state, in which the locking member is interlocked with the rotating member to keep the elastic sleeve in the torsional state, and a releasing state, in which the locking member is separated from the rotating member to allow the elastic sleeve to return to the non-torsional state; and an elastic member positioned between the lid body and the locking member and interacting with the locking member for driving the locking member to remain in the locking state.

2. The lid of claim 1, wherein the elastic sleeve comprises a first linking part, a twisting part and a second linking part, the first linking part is connected to an end of the twisting part and mounted in linkage with the rotating member, and the second linking part is connected to another end of the twisting part and mounted to the lid body.

3. The lid of claim 2, wherein the twisting part penetrates the lid body through the hole and configured for twisting and pressing the elastic spout to close.

4. The lid of claim 2, wherein an inner side of the lid body is provided with an annular convex structure in a circumferential direction of the hole, the twisting part of the elastic sleeve penetrates the annular convex structure and the second linking part of the elastic sleeve is fixed on the annular convex structure by a pressure ring.

5. The lid of claim 4, wherein the annular convex structure is provided with at least one fixing groove, the second linking part is provided with at least one fixing flange, and the at least one fixing flange is coupled to the at least one fixing groove.

6. The lid of claim 5, wherein the pressure ring is provided with an extending part pressing on the second linking part, and the pressure ring is threadedly engaged to the annular convex structure.

7. The lid of claim 2, wherein the rotating member comprises an actuating element and a base, the actuating element is provided with at least one bulge, the base is provided with at least one notch coupled with the at least one bulge, the actuating element is mounted on the base by matching the at least one notch with the at least one bulge.

8. The lid of claim 7, wherein the first linking part is fixed by the actuating element and the base.

9. The lid of claim 8, wherein the first linking part is provided with at least one limiting gap and at least one location hole separated from the at least one limiting gap, the actuating element is provided with at least one location bar coupled with the at least one location hole, the at least one location bar is engaged in the at least one location hole, in order to achieve a fixation of the actuating element and the first linking part; the base is provided with at least one limiting bar separated from the at least one notch and coupled with the at least one limiting gap, the at least one limiting bar is engaged in the at least one limiting gap, so that the elastic sleeve can be restricted from rotating along an axis of the base.

10. The lid of claim 7, wherein a mounting groove is defined in an outer side of the lid body around the hole, the locking member is axially and slidably disposed in the mounting groove, the rotating member is located on the locking member.

11. The lid of claim 10, wherein a button groove connected to the mounting groove is further defined on the outer side of the lid body, the locking member is provided with a release button located in the button groove, and the release button is configured for driving the rotating member to release from the locking member in the releasing state.

12. The lid of claim 10, wherein the base is further provided with a plurality of limiting gears on a side toward the locking member, the locking member is provided with a plurality of locking claws that cooperates with the plurality of limiting gears to limit rotation of the base to one direction.

13. The lid of claim 10, wherein the elastic member is a compression spring disposed in the mounting groove, and one end of the compression spring abuts on the bottom of the mounting groove, and the other end of the compression spring abuts on the locking member and interacts with the locking member.

14. A container comprising the lid of claim 1 and a container body.

* * * * *